US009914006B1

(12) United States Patent
Bell

(10) Patent No.: US 9,914,006 B1
(45) Date of Patent: Mar. 13, 2018

(54) I-LIFT

(71) Applicant: Jared R. Bell, Pearl City, HI (US)

(72) Inventor: Jared R. Bell, Pearl City, HI (US)

( * ) Notice: Subject to any disclaimer, the term of this patent is extended or adjusted under 35 U.S.C. 154(b) by 0 days.

(21) Appl. No.: 15/273,707

(22) Filed: Sep. 23, 2016

(51) Int. Cl.

| | |
|---|---|
| ***A63B 22/20*** | (2006.01) |
| ***A63B 21/06*** | (2006.01) |
| ***A63B 21/072*** | (2006.01) |
| ***A63B 21/00*** | (2006.01) |
| ***A63B 21/075*** | (2006.01) |
| ***A63B 23/12*** | (2006.01) |

(52) U.S. Cl.
CPC .... *A63B 21/0722* (2015.10); *A63B 21/00061* (2013.01); *A63B 21/00065* (2013.01); *A63B 21/00069* (2013.01); *A63B 21/075* (2013.01); *A63B 21/0726* (2013.01); *A63B 22/20* (2013.01); *A63B 23/1236* (2013.01)

(58) Field of Classification Search
CPC ..... A63B 21/0722; A63B 21/00061; A63B 21/00065; A63B 21/00069; A63B 21/0726; A63B 21/075; A63B 23/1236; A63B 22/20; A63B 21/4035; A63B 21/0004; A63B 23/0211; A63B 2208/0219; A63B 22/203; A63B 21/068; A63B 23/03541; A63B 21/4043; A63B 21/4049
USPC ..... 482/106–108, 132; D21/662, 679, 680, D21/694
See application file for complete search history.

(56) References Cited

U.S. PATENT DOCUMENTS

| | | | | | |
|---|---|---|---|---|---|
| 2,817,347 | A * | 12/1957 | Hilt, Sr. | A61H 3/00 | 135/65 |
| 5,842,957 | A * | 12/1998 | Wheeler | A63B 21/0602 | 482/106 |
| 5,879,274 | A * | 3/1999 | Mattox | A63B 21/0605 | 482/107 |
| D479,289 | S * | 9/2003 | Turner | D21/662 | |
| 6,875,161 | B1 * | 4/2005 | Brice | A63B 21/0724 | 482/107 |
| D695,364 | S * | 12/2013 | Khalil | D21/662 | |
| 9,283,426 | B2 * | 3/2016 | Robertson | A63B 22/20 | |
| 9,533,183 | B1 * | 1/2017 | Khalil | A63B 21/0004 | |
| 2002/0091045 | A1 * | 7/2002 | Wince | A63B 21/0724 | 482/106 |
| 2003/0096683 | A1 * | 5/2003 | Fenelon | A63B 21/0601 | 482/107 |
| 2004/0067826 | A1 * | 4/2004 | Elledge | A63B 21/0601 | 482/106 |
| 2005/0065003 | A1 * | 3/2005 | Klotzki | A63B 21/072 | 482/107 |
| 2005/0143229 | A1 * | 6/2005 | Marr | A63B 21/075 | 482/108 |

(Continued)

*Primary Examiner* — Andrew S Lo
(74) *Attorney, Agent, or Firm* — RG Patent Consulting, LLC; Rachel Gilboy

(57) ABSTRACT

A dumbbell used as a weight training device during a weight training or exercise program. Ball bearing wheels are used to allow user to accomplish most chest workouts with pushup form flies, and acting as pushup stands, ILIFTS allow deeper pushups. The dumbbell includes a gripping handle and a pair housing to secure weight plates inside. The provided handle is capable in rotating and the main advantage of the invention, there is disassembly is not required to move from one to another workout without any difficulties. The whole device is made from stainless steel, ball bearing wheels, and rubber cushion grip.

11 Claims, 2 Drawing Sheets

(56) References Cited

U.S. PATENT DOCUMENTS

| | | | | |
|---|---|---|---|---|
| 2008/0287272 | A1* | 11/2008 | Luckadue | A63B 21/027 482/107 |
| 2011/0152042 | A1* | 6/2011 | Anderson | A63B 21/072 482/108 |
| 2012/0238420 | A1* | 9/2012 | Meininger | A63B 21/00076 482/132 |
| 2013/0217549 | A1* | 8/2013 | Marji | A63B 21/068 482/132 |
| 2014/0018217 | A1* | 1/2014 | Brown | A63B 22/20 482/132 |
| 2014/0066269 | A1* | 3/2014 | Wheler | A63B 21/028 482/110 |
| 2014/0371040 | A1* | 12/2014 | Vasquez | A63B 1/00 482/132 |
| 2016/0067541 | A1* | 3/2016 | Lopez | A63B 22/20 482/124 |
| 2017/0319895 | A1* | 11/2017 | Davis | A63B 21/0724 |

* cited by examiner

I-LIFT

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of weight training devices and more specifically relates to a weight training device which could be quickly converted into another device for another workout and also the device could be used for several workouts without any conversions to equipment.

2. Description of the Related Art

Many people engage in weight training, to build strength and increase overall fitness. Weight training normally utilizes the force of gravity to oppose the force generated by the muscles—normally, weighted barbells, dumbbells and kettlebells are lifted and moved by the user in different ways to achieve different effects on a range of muscle groups.

Free weight training for physical fitness requires that specific weights be used for specific exercises and that those weights are changed throughout the exercise session to match the exercise being performed. This requires the user to have an array of dumbbells of varying poundage or a pair of adjustable units whose weight can be changed by adding or removing weight plates.

Dumbbells are one of the most widely used weight-training equipment pieces. One dumbbell consists of two equal weights that are attached to a handle, and the weights can be fixed or removable. The main reason people use dumbbells is to build and tone muscles, and they can be used to develop muscles in most parts of the body. Dumbbells come in many different weights and sizes, and they can be made of metal, concrete or other materials.

One of the most common inventions to compare to the ILIFT is the PERFECT FITNESS RIP DECK. The advantages of the ILIFT offers and the PERFECT FITNESS RIP DECK does not is, further movement and stretching with no limitation for all sized users. No restriction of movement or change of pushup style. Without any hesitation the user can go right into abdominal workouts and right back into a different pushup style without stopping. Then into dumbbell workouts. Hence, what is desirable is a mechanically simple and easy-to-use dumbbell weight training device having a series of interchangeable weight plates with correspondingly different weights that are adapted to be detachably connected to one another so that the gross weight of a single dumbbell may be selectively and progressively varied to conform to the weight training program of the user.

Various attempts have been made to solve the problems which may be found in the related art but have thus far been unsuccessful. A need exists for a reliable I-Lift to avoid the above-mentioned problems. None of the above inventions and patents, taken either singly or in combination, is seen to describe the invention as claimed.

Ideally, a weight training device should be user-friendly and safe in-use and, yet may operate reliably and be manufactured at a modest expense. Thus, a need exists for a weight training device to permits a user to quickly and easily vary the gross weight of a single dumbbell by adding or removing different weight plates having correspondingly different characteristic weights. To this end, each weight plate is preferably of uniform size, thickness and rectangular shape. An outer body manufactured from a durable material surrounds a steel frame, the size and weight of which determines the overall weight of the weight plate and to avoid the above mentioned problems.

BRIEF SUMMARY OF THE INVENTION

In view of the foregoing disadvantages inherent in the known weight training device art, the present invention provides a novel Weight Training Device (Entitled I-Lift). The general purpose of the present invention, which will be described subsequently in greater detail is to provide a weight training device to permit a user to quickly and easily vary the gross weight of a single dumbbell by adding or removing different weight plates having correspondingly different characteristic weights. To this end, each weight plate is preferably of uniform size, thickness and rectangular shape. An outer body manufactured from a durable material surrounds a steel frame, the size and weight of which determines the overall weight of the weight plate.

A weight training device is disclosed herein in a preferred embodiment comprising a gripping handle; a first housing; a second housing; at least one first weight plate member; at least one second weight plate member; a first cap member; and a second cap member. The first housing is attached to a first end of said gripping handle. The at least one first weight plate member is removably placed within the first housing. The at least one second weight plate member is removably placed within the second housing. The first cap member is releasably attached to the first housing and adapted to enclose the at least one first weight plate member within the first housing. The second cap member is releasably attached to the second housing and adapted to enclose the at least one second weight plate member within the second housing.

The present invention holds significant improvements and serves as a Weight Training Device. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, Weight Training Device (Entitled I-Lift) constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a weight training device and more particularly to weight training device (Entitled I-LIFT) to permit a user to quickly and easily vary the gross weight of a single dumbbell by adding or removing different weight plates having correspondingly different characteristic weights. To this end, each weight plate is preferably of uniform size, thickness and rectangular shape. An outer body manufactured from a durable material surrounds a steel frame, the size and weight of which determines the overall weight of the weight plate.

Figure 1:
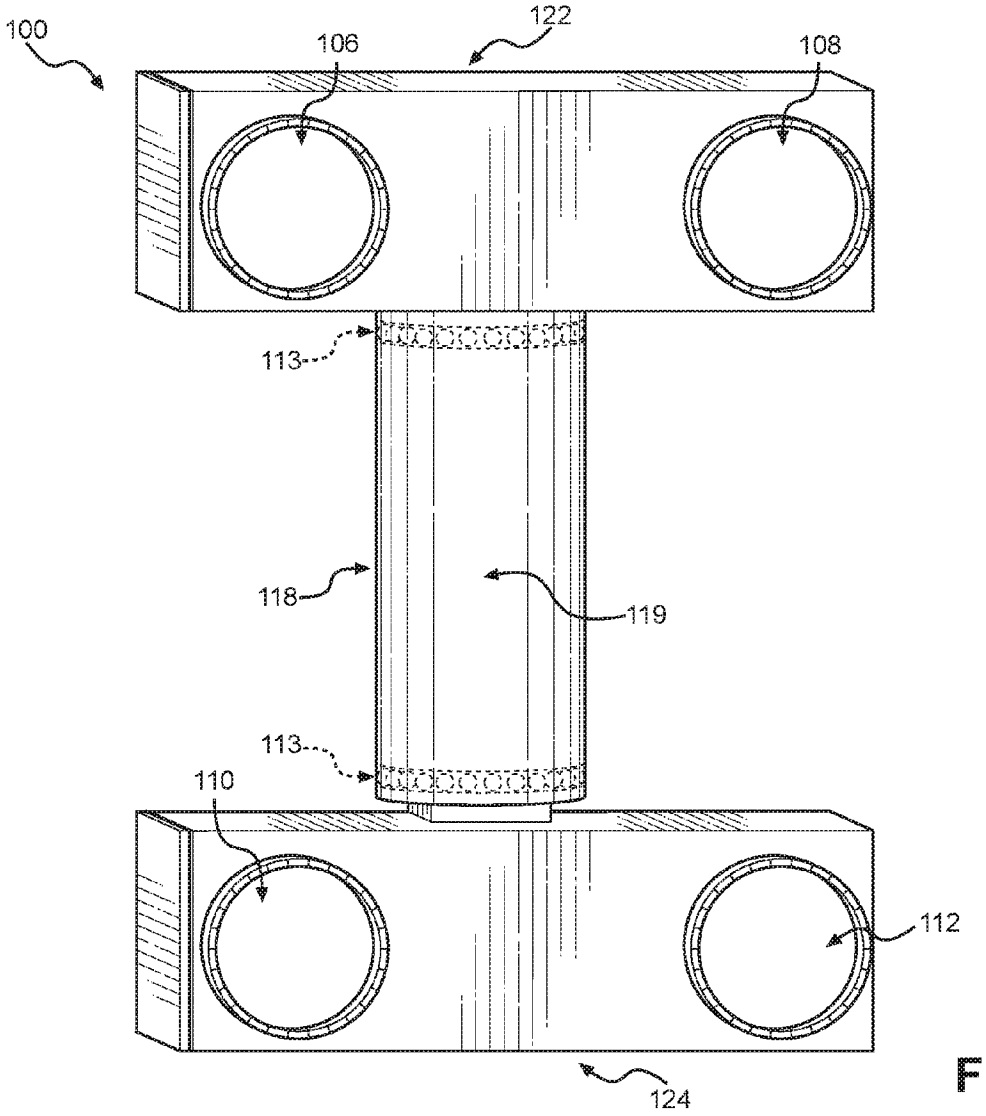
FIG. 1 is a front view of a collapsible weight system, in accordance with the present invention, generally showing a dumbbell with weight members within each compartment member.
Figure 2:
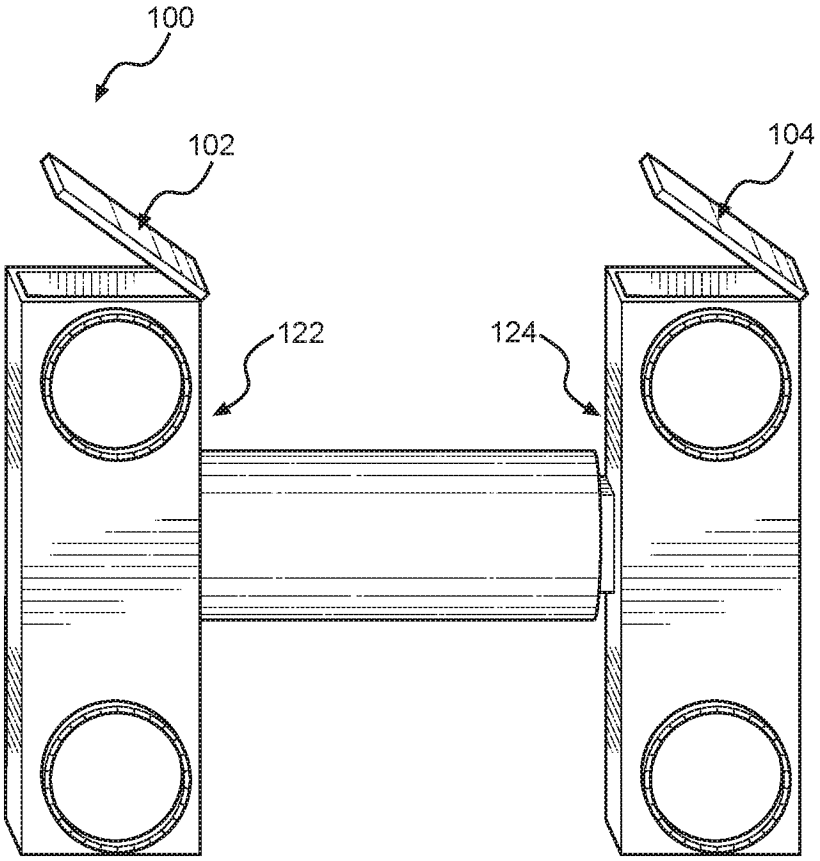
FIG. 2 is a front view of a weight training device, in accordance with the present invention, generally showing a dumbbell with weight members that can be placed within each compartment member.
Figure 2:
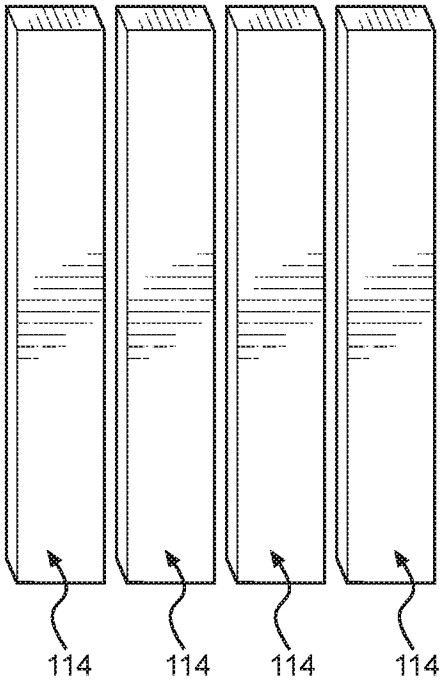

Referring to FIGS. 1 and 2, there is shown a versatile weight training device 100 of the type to be used as a personal exercise and weight training device. Thus, the weight training device 100 will be typically found at a fitness center or at home to be repeatedly lifted by one seeking to improve his physical appearance, strength and conditioning.

The weight training device 100 has a cylindrical handle 118 that extends between and is fixedly connected to opposing rectangular housing 122 and 124. The handle 118 is sized to be gripped within a single hand of a user. As will be explained in greater detail hereinafter, a variable number of weight plates 114 can be detachably connected to each other and to respective ones of the rectangular housing 122 and 124 at opposite ends of the gripping handle 118. Gripping handle 118 further includes a sleeve 119 that is adapted to rotate around the gripping handle. Furthermore, two ball bearing ring members 113 are connected to opposite ends of said gripping handle and between a top surface of the gripping handle and an inside surface of the sleeve 119 to reduce friction between a user's hand and the gripping handle. Ideally, a total of two weight plates 114 will be detachably inserted or connected to each rectangular housing 122 and 124. However, any suitable number of weight plates can be carried by the rectangular housing 122 and 124 of device 100. By virtue of being able to vary the number of weight plates 114 to be carried by device 100, the gross weight of the device 100 can be selectively and incrementally changed so as to be tailored to conform to the weight training program of the user. There are four ball bearing wheel 106, 108, 110, and 112 are fixed on each end of the rectangular housing 122 and 124 adapted to allow movement of said weight training upon a supporting surface. After inserting the weight plates 114 in the rectangular housing 122 and 124 of device 100, there are two caps 102 and 104 at the one end for locking the weight plates inside the housing.

It is important to note that, there is no need to disassemble the device to move while changing one to another workout. The device is made from stainless steel and rubber for gripping. The shape of the device is "I" and its cloud provides better mass, stamina and flexibility to the user without using multiple weight training devices.

It is to be understood that the above description is intended to be illustrative, and not restrictive. For example, the above-discussed embodiments may be used in combination with each other. Many other embodiments will be apparent to those of skill in the art upon reviewing the above description.

Plural instances may be provided for components, operations or structures described herein as a single instance. Finally, boundaries between various components are somewhat arbitrary, and particular operations are illustrated in the context of specific illustrative configurations. Other allocations of functionality are envisioned and may fall within the scope of the inventive subject matter. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The invention claimed is:

1. A weight training device comprising:

a gripping handle including:

a first end;

a second end; and a ball bearing ring member respectively connected to each end of said gripping handle, and a sleeve member adapted to contact both said ball bearing ring members and cover said gripping handle and allow rotation therebetween during use;

a first housing including:
a first end portion including:
an outer surface; and
a ball bearing wheel;
wherein said ball bearing wheel is attached to said outer surface and is adapted to allow movement of said first end portion upon a supporting surface;
a second end portion including:
an outer surface; and
a ball bearing wheel;
wherein said ball bearing wheel is attached to said outer surface and is adapted to allow movement of said second end portion upon a supporting surface;
wherein said first housing is attached to said first end of said gripping handle;
a second housing including:
a first end portion including:
an outer surface; and
a ball bearing wheel;
wherein said ball bearing wheel is attached to said outer surface and is adapted to allow movement of said first end portion upon a supporting surface;
a second end portion including:
an outer surface; and
a ball bearing wheel;
wherein said ball bearing wheel is attached to said outer surface and is adapted to allow movement of said second end portion upon a supporting surface;
wherein said second housing is attached to said second end of said gripping handle;
at least one first weight plate member;
wherein said at least one first weight plate member is removably placed within said first housing;
at least one second weight plate member;
wherein said at least one second weight plate member is removably placed within said second housing;
a first cap member;
wherein said first cap member is releasably attached to said first housing and adapted to enclose said at least one first weight plate member within said first housing;
a second cap member;
wherein said second cap member is releasably attached to said second housing and adapted to enclose said at least one second weight plate member within said second housing.

2. The weight training device recited of claim 1, further comprising additional first weight plate members of varying weights adapted to be placed within said first housing such that a user can vary a number of first weight plate members therein and thereby an amount of weight within said first housing member; and additional second weight plate members of varying weights adapted to be placed within said second housing such that a user can vary a number of second weight plate members and thereby an amount of weight within said second housing member.

3. The weight training device recited of claim 2, wherein said first housing and said second housing are formed having a rectangular shape.

4. The weight training device recited of claim 3, wherein said first weight plate members and said second weight plate members are formed having a rectangular shape.

5. The weight training device recited of claim 1, wherein said weight training device is made from steel.

6. The weight training device recited of claim 1, wherein said sleeve member further includes a rubber material thereon and around an outer surface thereof.

7. The weight training device recited of claim 1, wherein said first and second cap members include locking members thereon adapted to releasably lock said first and second cap members upon their respective housing and thereby releasably lock said first and second weight plate members within their respective housing.

8. The weight training device recited of claim 1, wherein said first housing and said second housing are formed having a rectangular volume; and wherein said first weight plate members and said second weight plate members are formed having a rectangular volume adapted to fit within said rectangular volume of their respective housing.

9. The weight training device recited of claim 1, wherein said first and second cap members are each pivotally connected to their respective housing.

10. The weight training device recited of claim 9, wherein said first and second cap members include locking members thereon adapted to releasably lock said first and second cap members upon their respective housing and thereby releasably lock said first and second weight plate members within their respective housing.

11. The weight training device recited of claim 8, wherein said first weight plate members and said second weight plate members are formed having a rectangular volume sized such that a plurality of each can be placed within their respective housings at the same time thereby selectively increasing a weight of said weight training device.

* * * * *